US007244339B2

(12) United States Patent
Vergara Lopez

(10) Patent No.: US 7,244,339 B2
(45) Date of Patent: Jul. 17, 2007

(54) RETENTION AND DRAINAGE SYSTEM FOR THE MANUFACTURING OF PAPER

(76) Inventor: German Vergara Lopez, Ernesto Alvear 374, Puente Alto, Region Metorpolitana (CL)

( * ) Notice: Subject to any disclaimer, the term of this patent is extended or adjusted under 35 U.S.C. 154(b) by 206 days.

(21) Appl. No.: 10/840,313

(22) Filed: May 6, 2004

(65) Prior Publication Data

US 2004/0250971 A1 Dec. 16, 2004

Related U.S. Application Data

(63) Continuation-in-part of application No. 10/709,443, filed on May 5, 2004, now abandoned.

(30) Foreign Application Priority Data

May 5, 2003 (CL) ..... 904-2003

(51) Int. Cl.
*D21H 21/10* (2006.01)
*D21H 17/68* (2006.01)

(52) U.S. Cl. ..... 162/181.8; 162/168.1; 162/168.3; 162/183; 516/110

(58) Field of Classification Search ..... 162/181.8, 162/168.1, 168.3, 183; 516/110
See application file for complete search history.

(56) References Cited

U.S. PATENT DOCUMENTS 2,368,635 A * 2/1945 Lippincott ..... 162/181.6
2,972,560 A 2/1961 Zembel et al.
3,052,595 A 9/1962 Fye
4,305,781 A 12/1981 Langley et al.
4,605,702 A 8/1986 Guerro et al.
4,753,710 A 6/1988 Langley et al.
4,964,955 A * 10/1990 Lamar et al. ..... 162/164.6
4,980,025 A 12/1990 Andersson et al.
5,015,334 A * 5/1991 Derrick ..... 162/168.1
5,167,766 A * 12/1992 Honig et al. ..... 162/164.1
5,178,730 A 1/1993 Bixler et al.
5,194,120 A 3/1993 Peats et al.
5,484,834 A * 1/1996 Chung ..... 524/446
5,607,552 A 3/1997 Andersson et al.
5,629,368 A * 5/1997 Chung ..... 524/446

(Continued)

FOREIGN PATENT DOCUMENTS

DE 2262906 10/1973

(Continued)

*Primary Examiner*—Eric Hug
*Assistant Examiner*—Dennis R. Cordray
(74) *Attorney, Agent, or Firm*—Daniel F. Nesbitt; Hasse & Nesbitt LLC

(57) ABSTRACT

A process for manufacturing a paper stock for use in making paper, paperboard and similar cellulosic products, by adding, at one or more different points of the wet end of the paper-making machine, a secondary retention and drainage agent containing a liquid smectite, and a primary retention and drainage agent comprising a natural or synthetic polymer. The retention and drainage agents can be added in any order, thus improving the retention, drainage, formation and drying, without affecting the whiteness, and enhancing the physical values of the paper, paperboard, cardboard and other similar products. The smectite can be an enhanced, concentrated, liquid smectite that can avoid the need for an on-site preparation unit.

19 Claims, 2 Drawing Sheets

U.S. PATENT DOCUMENTS

| | | | | |
|---|---|---|---|---|
| 5,779,785 | A | 7/1998 | Miranda et al. | |
| 5,807,475 | A * | 9/1998 | Kulprathipanja et al. | 208/208 R |
| 5,810,971 | A * | 9/1998 | Chung | 162/168.1 |
| 5,876,563 | A | 3/1999 | Greenwood | |
| 6,033,524 | A * | 3/2000 | Pruszynski et al. | 162/165 |
| 6,068,054 | A * | 5/2000 | Bragg | 166/270 |
| 6,113,741 | A | 9/2000 | Kettunen et al. | |
| 6,193,844 | B1 * | 2/2001 | McLaughlin et al. | 162/181.6 |
| 2002/0124979 | A1 | 9/2002 | Xiao et al. | |
| 2002/0139502 | A1 * | 10/2002 | Hallstrom et al. | 162/168.3 |
| 2002/0195218 | A1 | 12/2002 | Chen et al. | |
| 2003/0150575 | A1 | 8/2003 | Hund et al. | |
| 2004/0040683 | A1 | 3/2004 | Hund et al. | |

FOREIGN PATENT DOCUMENTS

| | | |
|---|---|---|
| EP | 0 235 893 | 5/1990 |
| GB | 1265496 | 3/1972 |
| WO | WO 99/14432 | 3/1999 |

* cited by examiner

RETENTION AND DRAINAGE SYSTEM FOR THE MANUFACTURING OF PAPER

CROSS-REFERENCE TO RELATED APPLICATIONS

The present application is a continuation-in-part application of U.S. patent application Ser. No. 10/709,443, filed May 5, 2004 now abandoned.

BACKGROUND OF THE INVENTION

The present invention generally refers to the manufacturing process of paper, paperboard, cardboard and similar products, such as cellulose, fiber cement, and others. The retention and drainage systems aim at improving the drainage (the capacity to eliminate water) and the retention of fines and fillers, which are part of the paper sheet.

These systems have evolved, coming from one retention and drainage agent to two and more components used today. Each one of them shows advantages and disadvantages, while the systems most used are the ones based on microparticles.

The benefits expected from a retention and drainage system are the following: higher production (ton/hr); lower production costs; lower energy consumption; better stability and reliability of the production systems; less acidity in the system due to the decrease of aluminum sulphate and consequently fewer corrosion problems; better formation of the paper sheet (seen against the light); less porosity of the paper; and less humidity of the paper.

Traditionally the paper machines have worked with retention agents, such as: natural polymers such as starch; synthetic polymers such as cationic, anionic, amphoteric and non-ionic polyacrylamides; and polyethylene oxide.

These products have the characteristic to "retain" a higher number of solids in suspension (fines and fillers) than the stock on its own without these additives.

Therefore, these days it is common practice in the paper manufacturing industry to use stock retention and drainage aids.

In the prior art several stock retention and drainage aids are known, such as the polyacrylamides (PAM), polyethylenimines (PEI), polyamides and polyamines, mainly.

Thus, for example, in the U.S. Pat. No. 3,052,595 (the disclosure of which is incorporated herein by reference) the use of polyacrylamides with filler is described and it is stated that advantageous results are obtained when bentonite provides 1 to 20% by weight of the mineral filler. In the British Patent No. 1.265.496 it is described how polyacrylamides are used to retain organic filler and cellulosic fines but that critical conditions have to be observed for successful operation, and particular modified acrylamides are described.

In the German Patent No. 2262906 (the disclosure of which is incorporated herein by reference) it is proposed to improve the dewatering of cellulosic slurries by adding bentonite and a low molecular weight cationic polymer that serves as a poly-electrolyte. In the prior art, the amount of bentonite included in the pulp is generally between 0.02 and 2% by weight dry bentonite clay, based on dry weight of paper or pulp, and most preferably it is between 0.1 and 1%. The bentonite-type clay used in the invention may be one of the common commercially available bentonites (known as montmorillonite clays) such as "Wyoming bentonite" and "Fullers Earth", and may or may not be chemically modified, e.g. by alkali treatment to convert the calcium bentonite substantially to alkali (e.g. sodium, potassium or ammonium) bentonite.

Another document related to the subject of the present invention is the U.S. Pat. No. 4,753,710 (the disclosure of which is incorporated herein by reference) granted to the company Allied Colloids in which a process is described according to which a cationic polymer, preferably polyethylenimine, a polyamine epichlorhydrin product, a polymer of diallyl dimethyl ammonium chloride, or a polymer of acrylic monomers is added to a watery cellulosic suspension before the last shearing stage, and bentonite is added after this shearing stage. This process allows for better retention, drainage, drying and web forming properties. The bentonite used in the said process is called "Hydrocol".

Respectively, according to the paper production method described in the U.S. Pat. No. 5,178,730 (the disclosure of which is incorporated herein by reference), granted to the company Delta Chemicals, there is added to the stock before the shearing stage a cationic polymer, which is preferably a tertiary or quaternary amine derivative of polyacrylamide, and after the shearing stage, before the head box, there is added a natural hectorite at a weight ration 0.5:1–10:1. The method according to this patent can be used in alkaline and acid paper production processes.

In the U.S. Pat. No. 5,876,563 (the disclosure of which is incorporated herein by reference), of Allied Colloids, a cationic starch together with a cationic polymer and an anionic microparticulate material is used as the retention aid.

On the other hand, according to the Patent WO 99/14432 of Allied Colloids (the disclosure of which is incorporated herein by reference), the microparticulate aid is preferably bentonite, silica, a polysilicic acid, polysilicate microgel, or an aluminum-modified version thereof.

The use of silicate microparticles together with a cationic polymer in a retention system is described in the U.S. Pat. 5,194,120 of Delta Chemicals (the disclosure of which is incorporated herein by reference). The prevalent cation in the synthetic amorphous metal silicate was magnesium, and the polymer was preferably a tertiary or quaternary amine derivative of polyacrylamide, their weight ratio being between 0.03:1 and 30:1. By this method, retention, dewatering and formation were improved by using smaller amounts of retention aids than previously, and thus the costs were correspondingly lower.

Through U.S. Pat. No. 4,305,781, granted to Allied Colloids in 1981 (the disclosure of which is incorporated herein by reference), the use of a clay in combination with a synthetic polymer, generally based on a non-ionic linear polymer, was introduced. The combination and the adding order, first clay then polymer, increased drainage and retention. Today this is known as the dual system (two components) or microparticulate system (particle size between nanometers and micrometers).

Here below this and other systems of the prior art and their disadvantages will be described in detail:

The so-called ORGANOPOL system, described in Patent No. EP-A-0 235893 (the disclosure of which is incorporated herein by reference), consisted of two chemical products.

The first product was ORGANOSORB, which is an activated or modified bentonite, an inorganic pigment in powder, which is added as a slurry at 1.5–5% by weight in concentration, preferably 2.5% by weight to the level box. An automatic unit for the preparation of the dispersion of the bentonite in powder was used, an on-line continuous process, that is, not by batch, generating the following problems:

1. No adequate swelling is produced; that is, no delamination of the bentonite is produced, since the dispersion residence time in the automatic bentonite preparation equipment is very short. Therefore the bentonite does not increase the retention capacity of the colloidal and semi-colloidal particles of organic and inorganic compounds present in the stock the paper, paperboard, cardboard and other similar products are made with.

2. There are variations in the concentration of the bentonite dispersion added to the stock system the paper, paperboard, cardboard and other similar products are made with.

3. The required equipment of continuous preparation is very big, complex, difficult to operate and handle and has a very high cost, (U.S. $80.000).

4. The concentrations of bentonite above 5% by weight form very viscous, gel-like dispersions that are difficult to pump.

The second product was ORGANOPOL polymer, which is an essentially linear cationic polyacrylamide with molecular weights of more than one million, three million and higher (according to Patent No. EP-A-0 235893) is added to the thin, diluted stock, after the pressure screen.

The polymer added at this point, does not allow to reduce the size of the floccules, no smaller, tougher and more uniform floccules are obtained, and therefore there is no good formation of the paper, paperboard or cardboard sheet.

The ORGANOPOL system presents the following disadvantages: loss of whiteness, with the consequent increase of the use of optical whiteners, the adverse impact of the retention and drainage and the complex handling of the bentonite.

Afterward, in the U.S. Pat. No. 4,753,710 (corresponding to the Hydrocol process), granted in the year 1988, basically the same idea is presented, apart from the fact that the order of adding the two products to the machine is inverted, that is, first the polymer is added, and then the clay (a bentonite). The description is based on cationic linear polymers of high molecular weight before a shearing stage, and after the shearing stage the clay (bentonite) is added. Preferably at the last shearing point, which is the pressure screen.

It is important to point out that both patents, but especially the latter one, make a big distinction at the shearing point, and focuses on a specific type of polymer.

The aforementioned Hydrocol system presents several problems, including: the necessity of an on-site preparation equipment of high cost, approx. U.S. $80.000; poor hydration of the bentonite (the maximum levels are not achieved); high consumption of the product (2 to 6 kilos per ton of paper); high energy consumption; more complex operation; loss of whiteness; and excessive retention with a negative effect on the drainage.

Until today many dual systems have been presented, with the same objectives, but none have been able to overcome these inconveniences.

The existing systems are presented here below in Table 1 explaining the basic operation principles:

TABLE 1

| System (Company) | Component 1 | Component 2 | Component 3 |
|---|---|---|---|
| Particol (CIBA) | Cationic polyacrylamide | Colloidal silica | |
| Poliflex (CIBA) | Cationic polyacrylamide | Inverse anionic micro-emulsion | |
| Composil (EKA) | Cationic starch with high substitution | Polysilicic acid | |

TABLE 1-continued

| System (Company) | Component 1 | Component 2 | Component 3 |
|---|---|---|---|
| | degree | | |
| Positek (Nalco) | Cationic coagulant | High molecular weight flocculant | Borosilicate |
| Mosaic (Buckman) | Coagulant | Polyacrylamide | Microparticle (4 alternatives) |

The before mentioned systems of the prior art present some advantages and disadvantages to be mentioned hereafter:

Particol has the advantage of using low application doses and its on-site preparation diminishes the possibility of losing effectiveness. The counterpart is the complex equipment at the client's plant.

Composil is a system which has good retention and drainage results, does not affect the strength properties and does not have any impact on the consumption of optical whiteners. However, the problem is that it is only effective in alkaline systems, it is expensive and good control must be kept on the dose (equipment).

Positek and Mosaic systems need more components, and therefore have more equipment and variables to control; they are more complex systems.

These and other inconveniences of the procedures of the prior art have been solved through the present invention, a detailed description of which will follow hereafter.

BRIEF DESCRIPTION OF THE INVENTION

The present invention provides a process for the retention and drainage of a stock that is used in the manufacturing of paper, paperboard, cardboard and other similar products, comprising the steps of:

1) adding, in a first stage, a secondary retention and drainage agent that is capable of retaining fines, colloidal and semi-colloidal particles of organic and inorganic compounds present in the stock, at one or more of a plurality of points, and
2) adding, in a second stage, a primary retention and drainage agent that is selected from the group consisting of a linear, branched, or cross-linked polyacrylamide, a starch, a polyethylene oxide, a wet strength resin, a dry strength resin, an organic or inorganic coagulant, a polyvinylamine, and another three-dimensional modeling or architecture polymer, the primary agent being able to flocculate the stock.

Preferably, the primary retention and drainage agent is added before the fan pump and before, inside, and after the pressure screen of the paper machine.

The present invention provides a process for manufacturing a paper stock, comprising the step of adding, at one or more different points of the wet end of the paper-making machine, a secondary retention and drainage agent comprising an enhanced, concentrated, liquid smectite (avoiding herewith the need of an on-site preparation unit), and a primary retention and drainage agent comprising a natural or synthetic polymer. The retention and drainage agents can be added in any order, thus improving the retention, drainage, formation and drying, without affecting the whiteness, and enhancing the physical values of the paper, paperboard, cardboard and other similar products.

The present invention provides a new retention and drainage system for use in the manufacturing of paper, paperboard, cardboard and other similar products, for acid, neutral and alkaline environments, in which basically two products or chemical compositions are added to the paper stock:

1) a secondary retention and drainage agent, and 2) a primary retention and drainage agent.

The secondary retention and drainage agent can also be referred to herein as the secondary retention and drainage composition, as the secondary agent, and as the secondary composition. The primary retention and drainage agent can also be referred to herein as the primary retention and drainage composition, the primary agent, and the primary composition.

This system is more flexible when compared to the systems of the prior art. The system improves the process of drainage, retention, the formation of the sheet, and the drying, improves the physical parameters, and does not negatively affect the whiteness of the paper, cardboard, paperboard and other similar products.

Additionally, in some applications, the secondary retention and drainage agent can be used without the primary retention and drainage agent.

Traditionally polymer components have been considered primary or of more importance to the process of manufacturing paper, paperboard and cardboard for the retention, drainage and formation. The microparticulate component, or dual and even tertiary (3-component) systems, have come and presented an improvement regarding these variables and have been secondary to the principal (that is, the polymer).

In the present invention the liquid secondary retention and drainage agent is believed to be mainly responsible for the improvement of the present system.

BRIEF DESCRIPTION OF THE DRAWINGS

FIG. 2 illustrates the molecular structures of synthetic polymers used as the retention and drainage agents.

DETAILED DESCRIPTION OF THE INVENTION

The process of the present invention can be carried out on any conventional paper making apparatus. The thin stock that is drained to form the sheet is often made by diluting a thick stock that typically has been made in a mixing chest by blending together pigment, appropriate fibre, any desired strengthing agent or other additives, and water. Dilution of the thick stock can be by means of recycled white water. The stock can be cleaned in a vortex cleaner. Usually the thin stock is cleaned by passage through a centriscreen, or pressure screen. The thin stock is usually pumped along the apparatus by one or more centrifugal pumps known as the fan pumps. For instance the stock can be pumped to the pressure screen by a first fan pump. The thick stock can be diluted by white water to the thin stock at the point of entry of this fan pump or prior to the fan pump, e.g., by passing the thick stock and dilution water through a mixing pump. The thin stock may be cleaned further, by passage through a further pressure screen. The stock that leaves the final pressure screen may be passed through a second fan pump and/or a head box prior to the sheet forming process. This can be by any conventional paper or paper board forming process, for example flat wire fourdrinier, twin wire former or vat former or any combination of these.

Figure 1:
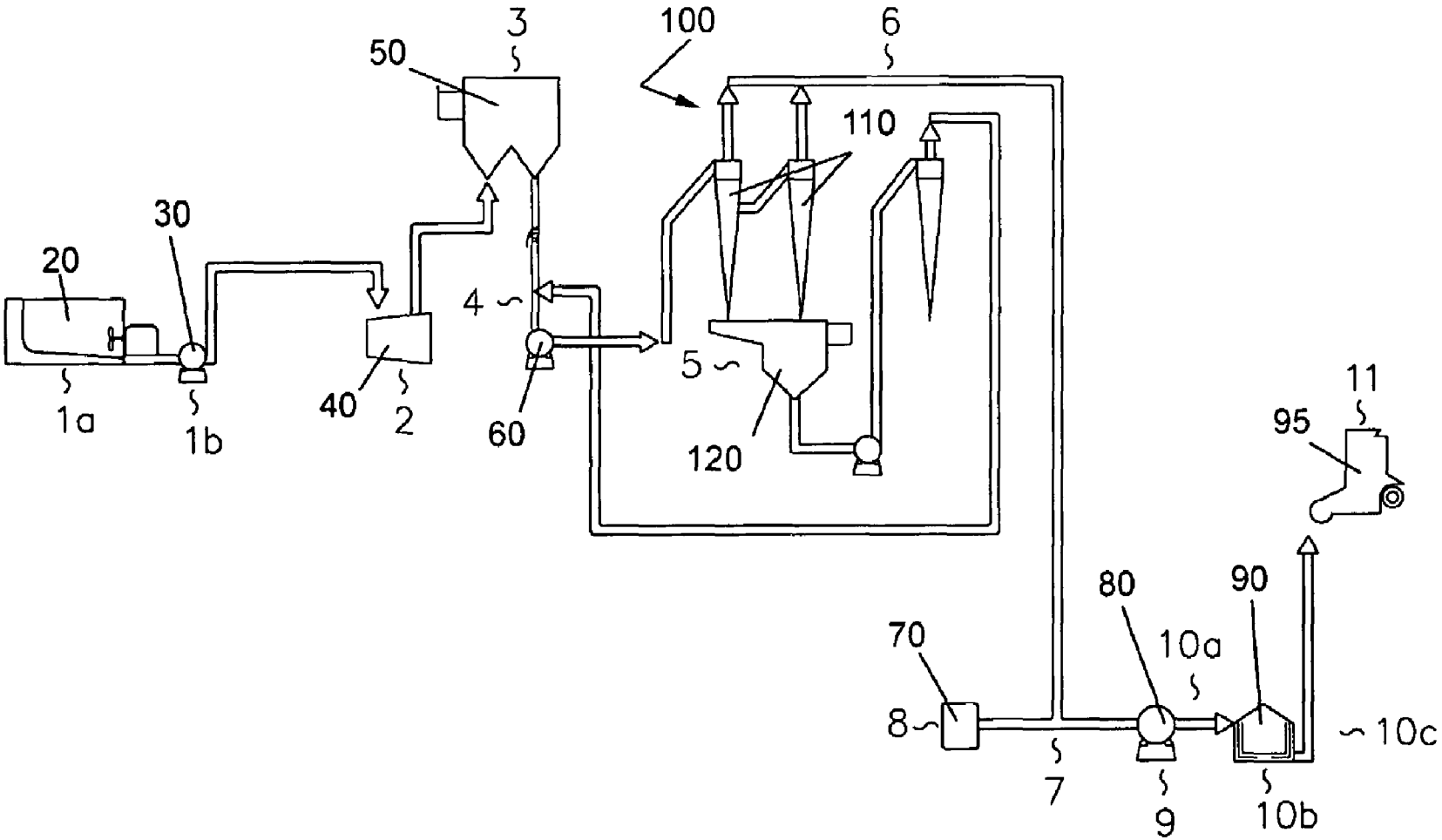
FIG. 1 is a flowchart of a process stream of a plant where paper, paperboard, cardboard or other similar products are manufactured, showing the equipment used and the adding points for the retention and drainage agents of the present invention.
Figure 2A:
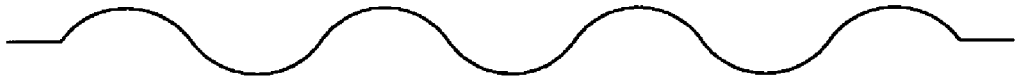
FIG. 2A represents a molecular structure of linear polymers.
Figure 2B:
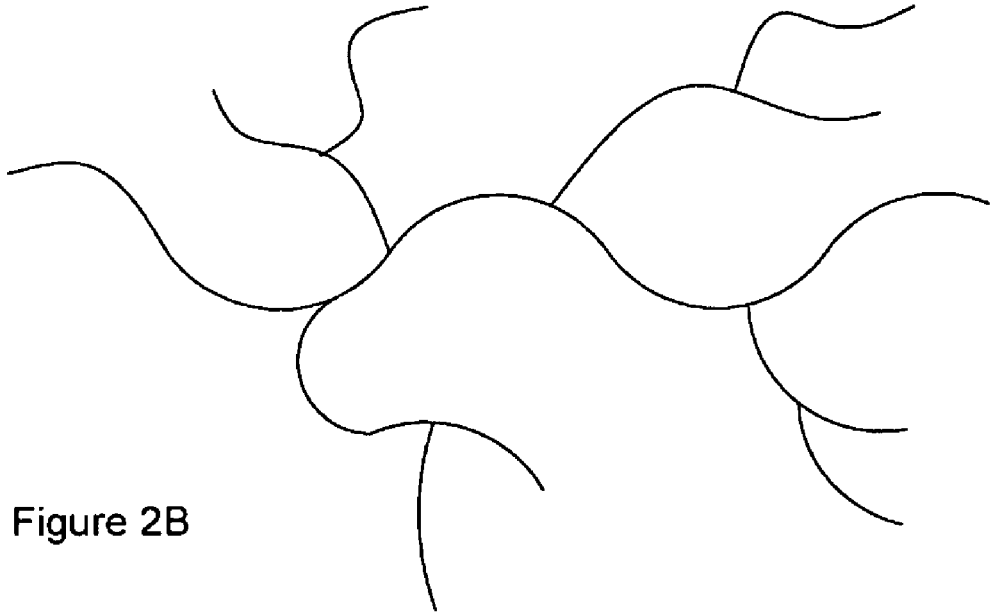
FIG. 2B represents a molecular structure of branched polymers.
Figure 2C:
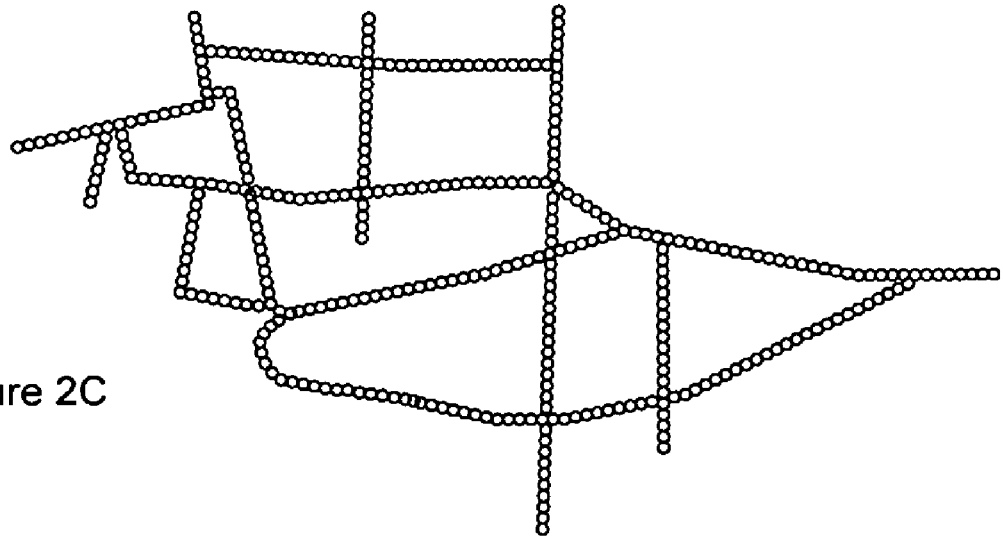
FIG. 2C represents a molecular structure of cross-linked polymers.

FIG. 1 shows the following treatment equipments relevant in the retention and drainage treatment process, including the points in the process where the primary and secondary retention and drainage agents of the present invention can be added. These points include:

point 1*a*, into a refined or non-refined stock tank 20;
point 1*b*, into a refined or non-refined stock tank pump 30;
point 2, into a refiner 40;
point 3, into a level box 50;
point 4, into a stock pump 60 feeding the depuration stage 100;
point 5, into other depuration stages 120;
point 6, at the feed into the first stage of the stock depuration stage 110;
point 7, at the arrival of the stock from the first stock depuration stage 110;
point 8, at the feeding of the dilution water supply 70 before the depurated stock enters;
point 9, into a fan pump 80;
point 10*a*, into the entry of a pressure screen 90;
point 10*b*, into the interior of the pressure screen 90;
point 10*c*, into the exit of the pressure screen 90; and
point 11, into the head box 95.

FIG. 1 in particular indicates the preferable points where the primary and secondary retention and drainage agents of the present invention can be added.

The secondary retention and drainage agent consists of a liquid formula composition that is typically manufactured by a supplier, and is capable of being introduced via a pump. The secondary retention and drainage agent comprises, as a main ingredient, a smectite or a chemically modified version thereof. Preferably, the smectite comprises a normal, activated or modified bentonite in a dispersion, with a concentration in the secondary agent of greater than 6.5% by weight. This secondary or dispersing agents allows, among other things, to strongly increase the specific, superficial area of the before-mentioned smectite with which the retention capacity of fines, colloidal particles, semi-colloidal particles, organic and inorganic compounds present in the paper stock with which paper, paperboard, cardboard and other similar products are manufactured, is improved. The secondary agent is added to the stock, and modifies the stock. The modified stock is flocculated by the primary retention and drainage agent.

The secondary retention and drainage agent of the present invention can be added to the paper machine at the following points of the process, indicated in FIG. 1:

point 1*b*, at the suction of the stock tank pump 30;
point 3, at the level box 50;
point 4, at the suction of the stock pump 60 feeding the stock depuration stage 100;
point 5, at other paper stock depuration stages 120;
point 6, at the outlet of the first stage of stock depuration 110;
point 8, at the dilution water supply 70 before the entry of the depurated stock;
point 9, before the fan pump 80;
point 10*a*, before the pressure screen 90;
point 10*b*, inside the pressure screen 90; and
point 10*c*, after the pressure screen 90.

In particular, the secondary retention and drainage agent, more easily retains the organic and inorganic compounds present in the stock from which the paper, paperboard, cardboard and other similar products (cellulose, fiber cement, etc.) are manufactured, which include fines, fillers, glues, starch, lignin and hemicelluloses.

The addition of the secondary retention and drainage agent of the present invention before the fan pump 80, and the primary retention and drainage agent before and inside the pressure screen 90 (at points 10*a* and 10*b*) of the paper machine, allows obtaining a higher general first-pass retention of the organic and inorganic compounds in the machines.

In addition, the addition of the secondary retention and drainage agent and the primary retention and drainage agent at the indicated points of the paper machine allows obtaining smaller, tougher and more uniform floccules, with which a better formation of the paper sheet is obtained. It allows to enhance the physical parameters of the paper, paperboard, cardboard and other similar products, such as the longitudinal strength, the transversal strength, CMT, ring crush, Cobb, Mullen explosion, Denisson, etc.

In addition, through this system (process), the primary and secondary retention and drainage agent added at the indicated points of the paper machine allow to increase the retention of the paper machine, with which a decrease in the consistency, and a decrease in the level of solids suspended in the "white water" (that is, in the water under the wire and the vats) is achieved.

Additionally, adding the secondary retention and drainage agent and the primary retention and drainage agent at the indicated points of the paper machine allows use of lower consistencies in the head box 95 (at point 11) of the paper machine, with which, among other things, a better distribution of the fibers in the wet sheet being formed on the wire or the vats is, achieved.

Moreover, adding the secondary retention and drainage agent and the primary retention and drainage agent according to the present invention, allows to increase the drainage capacity of the paper stock, to produce a dryer sheet at the end of the wire or the vats, with which a substantial saving in the consumption of steam is achieved, apart from increasing the speed and with this the production of the paper machine and maintaining, moreover, the stability thereof.

Through the retention and drainage system of the present invention it is possible to decrease the levels of dosage of the secondary retention and drainage agent to 150 g/ton of paper, equivalent to 40 g of smectite per ton/paper, and of the primary retention and drainage agent to 50 g/ton paper, obtaining high levels of retention and drainage of the fiber that are superior to those of the systems described in the prior art, for example the one called ORGANOPOL. With these before-mentioned dosage levels, a considerable saving in consumption and the consequent costs of the chemical products can be achieved by the present retention and drainage system in a paper machine according to the invention.

The preferable dosage level of the secondary retention and drainage agent according to the invention consisting of a pumpable liquid formula prepared in the chemical product supplier's plant, lies between 40 and 2,000 g/ton of paper more preferably between 150 and 1,000 g/ton of paper. By comparison, however, the dosage of a formula of the prior art consisting of a powder bentonite (for example, the ORGANOPOL system) lies between 2,000 and 6,000 g/ton of paper. Moreover, in this last case, a very large and expensive process unit is used in the continuous process of the preparation of the bentonite dispersion. The dosage of the primary and secondary retention and drainage agents according to the invention allows improvement of the quality of the manufactured paper, while complying with all the technical specifications and quality standards of the product manufactured in the paper machine.

In relation to the prior art, in particular the ORGANOPOL product of the company CIBA consists of a linear cationic polyacrylamide described in the patent No. EP-A-0 235893, is applied in the dual retention system ORGANOPOL and is added to the thin, diluted paper stock after the last point of major shearing of the machine, that is after the pressure screen 90 (point 10*c*) and flocculates the modified stock. However, the primary retention and drainage agent of the present invention can be added before and inside the pressure screen 90 (points 10*a*, 10*b*) to allow, in the first place, for the formation of big floccules in the modified stock, which, while passing through the before-mentioned pressure screen 90, form smaller, tougher and more uniform floccules, with which a better formation of the sheet of paper, paperboard, cardboard or other similar product without lumps in the stock is achieved. In the process of the present invention it is also possible to add the primary retention and drainage agent after the pressure screen 90 (point 10*c*).

Another advantage of the present invention through the process of adding the primary retention and drainage agent at the indicated adding points, is that it allows to reduce the tearing of the paper sheets and, consequently, to increase the productivity of the paper machine, and to reduce, moreover, the solids in suspension at the effluent of the machine or plant.

Another advantage of the invention lies in the fact that adding the primary retention and drainage agent at the indicated points of the paper machine allows reduction of the dosages of starch, glue and other chemical agents, maintaining the values within the standard, reducing the BOD and COD indexes at the effluent of the paper machine with the consequent advantages from environmental contamination point of view.

The retention and drainage agents, and the system of adding thereof according to the present invention, make it possible to use more recycled fibers in the paper machine.

Finally, the system of the present invention allows operation in acid, neutral or alkaline environments and does not affect the whiteness of the paper.

The before-mentioned primary retention and drainage agent flocculates the stock.

Adding the primary retention and drainage agent according to the invention can be done at points of the paper machine, between points 1*a* and 10*c* of the manufacturing process for making of paper, paperboard, and cardboard, shown in FIG. 1, and preferably at the following points:

point 9, before the fan pump 80;

point 10*a*, before the pressure screen 90;

point 10*b*, inside the pressure screen 90;

point 10*c*, after the pressure screen 90.

The primary retention and drainage agent can be or can comprise a compound or mixture of compounds well known in the art of paper making. Typically the primary retention and drainage agent is selected from the group consisting of a linear, branched or cross-linked polyacrylamide, a starch, a polyethylene oxide (PEO), a dry strength resin, a wet strength resin, an organic or inorganic coagulant, a polyvinylamine, or another three-dimensional modeling polymer. A suitable dry strength and temporary wet strength resin for use in the present invention is disclosed in U.S. Pat. No. 4,605,702, incorporated herein by reference.

The before-mentioned primary retention and drainage agent is preferably prepared in the user's or client's plant. If the ingredients are solid products, then the dissolution thereof can be effected in an automatic powder dissolution unit. If the ingredients are liquids, then the dissolution can be effected by means of an on-line dosage pump. The dosage range of the primary retention agent lies between 50 and 10,000 g/ton of paper.

Adding Stages:

A first stage (A) for adding the chemical products of the retention and drainage system according to the present invention is developed in the refined or non-refined stock tank 20 (point 1*a*). This refined or non-refined stock is the result of the disintegration of fibrous material that can include rags of cellulose, waste paper and brokers, etc., produced in a so-called "helix" or "pulper" equipment according to a production schedule. This fibrous material converted in stock and after going through the depuration stages, screens, etc., arrives at the refined or non-refined stock tank 20 (point 1*a*).

At the suction of the stock pump 30 (point 1*b*) of this refined or non-refined stock tank 20 (point 1*a*), as first adding point, the secondary retention and drainage agent, as a liquid chemical composition, is added.

The stock with the secondary retention and drainage agent contained therein goes to the fan pump 80 (point 9), pressure screen 90 (point 10), and then to the head box 95 (point 11). There are nine other possible points of adding, mentioned before, adequate for introducing the secondary retention and drainage agent to the paper stock to manufacture paper, paperboard, cardboard and similar products.

Adding the liquid, pumpable secondary retention and drainage agent can be easy. The secondary retention and drainage agent is typically manufactured in the plant of the supplier. It contains a smectite or a chemically modified version thereof, preferably a normal, activated or modified bentonite. Since the secondary retention and drainage agent is preferably distributed in containers of 1,000 kg, a variable caudal pump is sufficient to adequately add this product. In one a simple installation, an upper container containing 1,000 kg of the secondary retention and drainage agent product which mounted onto a stand to unload into a lower container at the rate consumed by the lower container. Finally, after several days, when the contents of the upper container is emptied, the upper is changed. The lower container is connected to a dosage pump.

A general example of the secondary retention and drainage agent has the following chemical formula, by weight: water at 0 to about 92%, dispersing agent at about 1 to about 80%, and smectite clay at about 8 to about 50%. The composition typically has a temperature in the range of from 5 to approximately 95° C. An application example is available as VERSINQUI A-250, having the following chemical formula, by weight: water at 66.4%, sodium polyacrylate at 9.1%, and smectite clay (preferably montmorillonite) at 24.5%. The composition typically has a temperature in the range of 40–60° C.

The secondary agent is typically prepared in the supplier's plant, and is brought to the paper plant for use. This allows for a de-lamination of the smectite (clay), which therefore, strongly increases the specific, superfacial area of the smectite, with which is achieved an increase in the retention of fines, colloidal particles, semi-colloidal particles of the organic and inorganic compounds present in the paper stock for the manufacturing of paper, paperboard, cardboard and other similar products. This thus modified stock is flocculated by the primary retention and drainage agent.

The pumpable liquid chemical composition of the secondary retention and drainage agent according to the invention allows a concentration of the smectite clay above 6.5% by weight in the watery dispersion, which current systems can not achieve.

The dosage of the secondary agent is controlled via a pump with variable caudal, preferable between 150 and 1,000 g/ton of final produced paper. The dispersing agent of the secondary agent is preferably an acrylate, and more preferably a sodium polyacrylate. However, it is also possible to formulate the secondary agent with other dispersing agents different from an polyacrylate, including: organic salts of alkylaryl-sulphonic acids; purified sulpholignine; extracts from seaweed; condensed proteins and fatty acids; sulphonate esters; high molecular weight alkyl sulphate, preferably an alkali, including the sodium, salt; polycarboxylic compounds; phosphate, including hexametaphosphate, pyrophosphate, and tripolyphosphate, and others; an alkali, preferably sodium, salt of polyaspartic acid; alcohol; acetone and other lower ketones; and glycerin.

The second stage (B) of the method according to the invention comprises adding the primary retention and drainage agent at one or more points between the position points 1*a* and 10*c* of the process stream drawing of FIG. 1. Preferably, the primary retention and drainage agent is added at the following points:

point 9, before the fan pump 80;
point 10*a*, before the pressure screen 90;
point 10*b*, inside the pressure screen 90; and
point 10*c*, after the pressure screen (10*c*).

The preparation and adding of the primary retention and drainage agent is preferably in the paper factory of the client. If the products are solid, then the dissolution is done in an automatic powder dissolution unit. If they are liquids, it is done by means of an on-line dilution dosing pump.

The dosage range of the primary retention and drainage agent lies between 50 and 10,000 g/ton final paper.

By comparison, in a conventional system, such as the ORGANOPOL system, the recommended adding points are the following:

Point 3, adding ORGANOSORB, bentonite dispersion, at the level box 50; and
Point 10*c*, adding ORGANOPOL, linear polyacrylamide, after the pressure screen 90.

Generally, in the process of the present invention, the sequence of adding the primary and secondary agents can be done indistinctly; that is, first the secondary retention and drainage agent and then the primary retention and drainage agent; or vice versa, first the primary retention and drainage agent and then the secondary retention and drainage agent. Additionally, in some applications the secondary retention and drainage agent can be used without the primary retention and drainage agent.

In the retention and drainage system according to the invention, referring to FIG. 1, the secondary retention and drainage agent can be added at:

point 1*b*, at the suction of the stock tank pump 30;
point 3, at the level box 50;
point 4, at the suction of the stock pump 60 feeding the stock depuration stage 100;
point 5, at other paper stock depuration stages 120;
point 6, at the feed into the first stage of the stock depuration stage 110;
point 7, at the arrival of the stock from the first stock depuration stage 110;
point 8, at the feeding of the dilution water supply 70 before the depurated stock enters;
point 9, into a fan pump 80;
point 10*a*, into the entry of a pressure screen 90;

point 10*b*, into the interior of the pressure screen 90; and point 10*c*, into the exit of the pressure screen 90.

The primary retention and drainage agent can be added between the stages of the process of manufacturing paper, paperboard, cardboard or other similar products from points 1*a* to 10*c* of FIG. 1, but preferably at:

point 9, into a fan pump 80;

point 10*a*, into the entry of a pressure screen 90;

point 10*b*, into the interior of the pressure screen 90; and point 10*c*, into the exit of the pressure screen 90.

I claim:

1. A process for the retention and drainage of a stock useful for the manufacturing of paper, paperboard, cardboard and other similar products, comprising the steps of:

(1) adding into paper stock from about 40 to about 2,000 grams of a secondary retention and drainage agent, per ton of produced paper, that retains fines, colloidal and semi-colloidal particles, and organic and inorganic compounds present in the stock, the secondary retention and drainage agent having a composition comprising a de-laminated smectite, and consisting essentially of, by weight:

(1) from about 1 to about 80% a dispersing agent selected from the group consisting of a polyacrylate, a purified sulpholignin, an extract of seaweed, a protein, a condensed fatty acid, a sulphonate ester, a high molecular weight alkyl sulphate, a polycarboxylic compound, a phosphate, a hexametaphosphate, pyrophosphate, and tripolyphosphate, a polyaspartic acid alkali salt, an alcohol, an acetone and other lower ketone, and glycerin, and mixtures thereof;

(2) from about 8 to about 50% de-laminated smectite; and (3) from 0 to about 92% water;

wherein the added secondary retention and drainage agent composition has a temperature in the range of from 5° to about 95° C.; and optionally, (2) adding a primary retention and drainage agent that flocculates the stock, the primary retention and drainage agent, selected from the group consisting of a linear, branched, or cross-linked polyacrylamide, a starch, a polyethylene oxide, a wet strength resin, a dry strength resin, an organic or inorganic coagulant, and a polyvinyl amine.

2. The process according to claim 1 wherein the secondary retention and drainage agent can be added at a point in the process selected from: Point (1*b*), at the suction of the stock tank pump (30); Point (3), at the level box (50); Point (4), at the suction of the stock pump (60) feeding the stock depuration stage (100); Point (5), at other paper stock depuration stages (120); Point (6), at the outlet of the first stage of stock depuration (110); Point (8), at the dilution water supply (70) before the entry of the depurated stock; Point (9), before the fan pump (80); Point (10*a*), before the pressure screen (90); Point (10*b*), inside the pressure screen (90); and Point (10*c*), after the pressure screen (90).

3. The process according to claim 1 wherein the primary retention and drainage agent can be added at a point in the process selected from before the fan pump (80), and before, inside and after a pressure screen (90) of the paper machine.

4. The process according to claim 2 wherein the secondary retention and drainage agent is added in a continuous way.

5. The process according to claim 1 wherein the secondary retention and drainage agent is added at a level in a range between 150 and 1,000 g/ton produced paper.

6. The process according to claim 1 wherein the secondary retention and drainage agent is added to the stock in an acid, neutral or alkaline environment.

7. The process according to claim 1 wherein the smectite comprises a montmorillonite.

8. The process of claim 1 wherein the composition of the secondary retention and drainage agent comprises by weight: (1) about 9.1% a dispersing agent; (2) about 24.5% smectite; and (3) about 66.4% water; and wherein the added composition has a temperature in the range of from about 40° C. to about 60° C.

9. The process of claim 1 wherein the process is performed in a paper plant, and wherein the secondary retention and drainage agent is provided as a composition prepared in a supplier's plant, and is brought to the paper plant for use.

10. The process of claim 1 wherein the smectite comprises a chemically modified smectite, a normal, activated or modified bentonite, and mixtures thereof.

11. The process according to claim 1 wherein the primary retention and drainage agent can be added in the process between point (1*a*) into a refined or non-refined stock tank, and point (10*c*), into the exit of the pressure screen (90).

12. The process of claim 11 wherein the primary retention and drainage agent can be added continuously at a point in the process selected from: point (9), into a fan pump (80); point (10*a*), into the entry of a pressure screen (90); point (10*b*), into the interior of the pressure screen (90); and point (10*c*), into the exit of the pressure screen (90).

13. The process of claim 1 wherein the primary retention and drainage agent is added at a level in a range between 50 and 10,000 g/ton produced paper.

14. The process of claim 13 wherein the primary retention and drainage agent is added at a level in a range between 100 and 6,000 g/ton produced paper.

15. The process of claim 1, wherein the step of adding the primary retention and drainage agent precedes the step of adding the secondary retention and drainage agent.

16. The process of claim 1, comprising only the step of adding the secondary retention and drainage agent.

17. The process of claim 5 wherein the composition of the secondary retention and drainage agent comprises by weight: (1) about 9.1% a dispersing agent; (2) about 24.5% smectite; and (3) about 66.4% water; the composition having a temperature in the range of from about 40° C. to about 60° C.

18. The process of claim 17 wherein the secondary retention and drainage agent composition is added at the suction of the stock pump (60) feeding the stock depuration stage (100).

19. The process of claim 5 wherein the level of smectite in the secondary retention and drainage agent is about 24.5% by weight.

* * * * *